US011701540B2

(12) United States Patent
Wolf

(10) Patent No.: US 11,701,540 B2
(45) Date of Patent: Jul. 18, 2023

(54) CORE TRAINER

(71) Applicant: Eugene M. Wolf, San Rafael, CA (US)

(72) Inventor: Eugene M. Wolf, San Rafael, CA (US)

( * ) Notice: Subject to any disclaimer, the term of this patent is extended or adjusted under 35 U.S.C. 154(b) by 74 days.

(21) Appl. No.: 17/519,966

(22) Filed: Nov. 5, 2021

(65) Prior Publication Data

US 2023/0142575 A1 May 11, 2023

(51) Int. Cl.

| | |
|---|---|
| ***A63B 21/055*** | (2006.01) |
| ***A63B 21/04*** | (2006.01) |
| ***A63B 21/00*** | (2006.01) |
| ***A63B 23/02*** | (2006.01) |

(52) U.S. Cl.

CPC ..... *A63B 21/0555* (2013.01); *A63B 21/0442* (2013.01); *A63B 21/4035* (2015.10); *A63B 21/4039* (2015.10); *A63B 23/0205* (2013.01)

(58) Field of Classification Search

CPC ..... A63B 21/0555; A63B 21/0442; A63B 21/4035; A63B 21/4039; A63B 23/0205

See application file for complete search history.

(56) References Cited

U.S. PATENT DOCUMENTS

| | | | | |
|---|---|---|---|---|
| 4,770,414 | A * | 9/1988 | Fredrickson | A63B 23/0227 482/148 |
| 4,856,773 | A * | 8/1989 | Deola | A63B 21/0626 482/102 |
| 5,190,512 | A * | 3/1993 | Curran | A63B 23/00 482/125 |
| 5,248,287 | A * | 9/1993 | Nicoletti | A63B 21/0618 482/106 |
| 5,312,314 | A * | 5/1994 | Stephan | A63B 21/072 482/106 |
| 6,379,287 | B1 * | 4/2002 | Slawinski | A63B 21/078 482/4 |
| 6,386,988 | B1 * | 5/2002 | Shearer | A63B 69/3614 473/274 |
| 7,090,627 | B1 * | 8/2006 | Walker | A63B 21/4015 482/121 |
| 9,278,252 | B1 * | 3/2016 | Will | A63B 21/055 |
| 9,764,177 | B2 * | 9/2017 | Baudhuin | A63B 21/068 |
| 10,080,916 | B2 * | 9/2018 | Lee | A63B 21/154 |
| 2006/0063652 | A1 * | 3/2006 | Berman | A63B 21/153 482/126 |
| 2007/0161468 | A1 * | 7/2007 | Yanagisawa | A63B 21/4017 482/139 |
| 2007/0173389 | A1 * | 7/2007 | Habing | A63B 21/4043 482/140 |
| 2009/0239675 | A1 * | 9/2009 | Wallace | A63B 69/36 482/129 |

(Continued)

*Primary Examiner* — Andrew S Lo

(74) *Attorney, Agent, or Firm* — Dergosits & Noah LLP; Todd A. Noah

(57) ABSTRACT

A core training apparatus for the golf swing. A semicircular member is coupled with a support member, and a resistance member is connected to one of the coupling points. The resistance member is secured to a fixed point, and the user rotates the apparatus back and forth with the user standing at the center rotational axis of the semicircular member, with the resistance member being guided along the semicircular member. The back-and-forth rotation acts to increase and decrease tension on the resistance member thereby exercising the core of the user.

22 Claims, 7 Drawing Sheets

(56) References Cited

U.S. PATENT DOCUMENTS

| | | | | |
|---|---|---|---|---|
| 2009/0312164 | A1* | 12/2009 | Placencia | A63B 23/0211 482/126 |
| 2014/0357458 | A1* | 12/2014 | Callanan | A63B 21/169 482/129 |
| 2017/0239515 | A1* | 8/2017 | Leong | A63B 22/14 |
| 2018/0028860 | A1* | 2/2018 | Braun | A63B 21/4005 |
| 2018/0126213 | A1* | 5/2018 | Estrada, Jr. | A63B 21/00189 |

* cited by examiner

CORE TRAINER

TECHNICAL FIELD

This disclosure relates generally to exercise and training devices, and more particularly, to a training device for building core strength and muscle memory to improve the power and mechanics of the golf club swing.

BACKGROUND

The most difficult thing for aspiring golfers to realize is that club head speed is dependent on the speed and power of the axis of rotation of the body, namely the core. However, human evolution and development have produced the condition "physiological hand dominance" in which our upper extremities (hands and arms) are naturally and physically dominant in most daily activities, as well as in most athletic activities. Unfortunately, this does not facilitate the development of a biomechanically advantaged golf swing.

The hand has the most complex motor activities of any part of our body, and those complex activities are reflected in the brain. The neurons dedicated to the function of the hand occupies the largest proportion of the motor and sensory cortices of the brain. Varying images of anatomy that are derived from the primary motor cortex of the brain show the dominance of the hand compared to core and lower extremities. This is true for both motor and sensory cortices.

This natural tendency is recognized by professionals and they are able to overcome upper extremity dominance. Renown swing coach Butch Harmon believes the typical golfer "tries to do too much with his hands" thereby diminishing his swing speed. He notes that his former pupil, Tiger Woods, focused on keeping his hands passive through the downswing. The most important aspect of hand motion, Harmon says, is to synchronize the movements of your hands with rotation of your body. Tiger Woods says he generates club head speed on the downswing "from the ground up" with hand movement occurring last. Golfers can generate more club head speed by rotating their core, and allowing their body's centrifugal force to release their hands naturally. It is the rotation of the core that produces club shaft "lag" that accelerates the club head through the ball.

Thus, the core's rotation in the golf swing is the key to club head speed. Therefore, it would be desirable to have a training device that is designed to increase the rotary power and muscle memory of the core structures while leaving the hands and arms relatively passive in the training motion. While the embodiments described herein are specifically directed to a training device for building core strength and muscle memory for a golf club swing, one skilled in the art would understand that the apparatus could be a training device for building core strength and muscle memory in other sports such as baseball. This device can be used in the home environment using elastic tethers, or a pulley weight system, or adapted for use in gyms using a pulleys/weight system for resistance.

DETAILED DESCRIPTION

A training device for a golf swing is described. The training device is designed to be used as a regular exercise to increase the rotary power and muscle memory of the user's core structures. Doing so increases the power, speed and participation of the core in the golf swing, while leaving the hands and arms relatively passive in the training motion. The core is the axis of rotation of the golf swing and the key to club head speed. The golf swing training device trains the muscles and joints of the core, thereby increasing their involvement in the golf swing.

Figure 1:
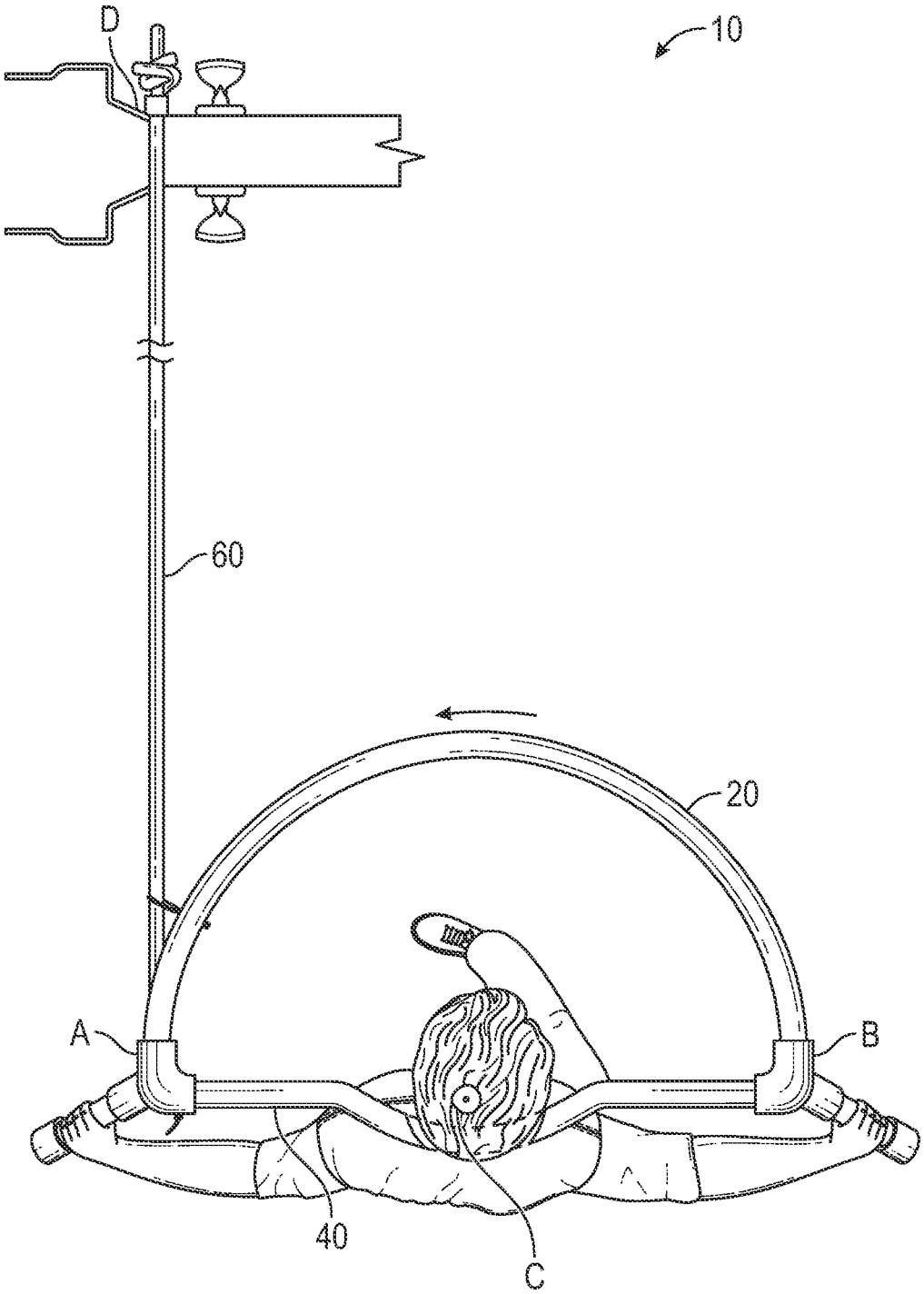
FIG. 1 is an overhead schematic view of a training apparatus in a first position.
Figure 2:
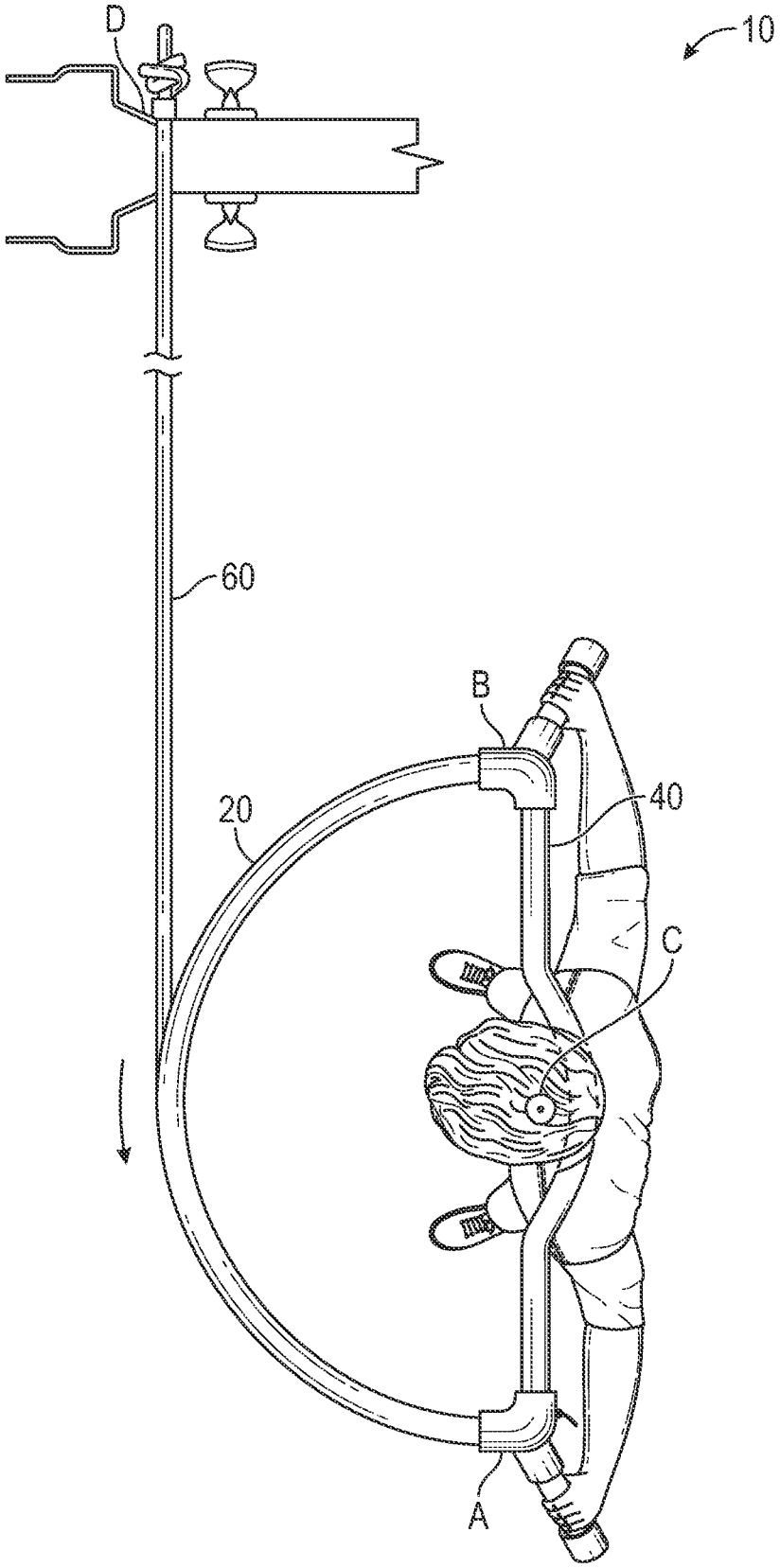
FIG. 2 is an overhead schematic view of the training apparatus of FIG. 1 in a second position.
Figure 3:
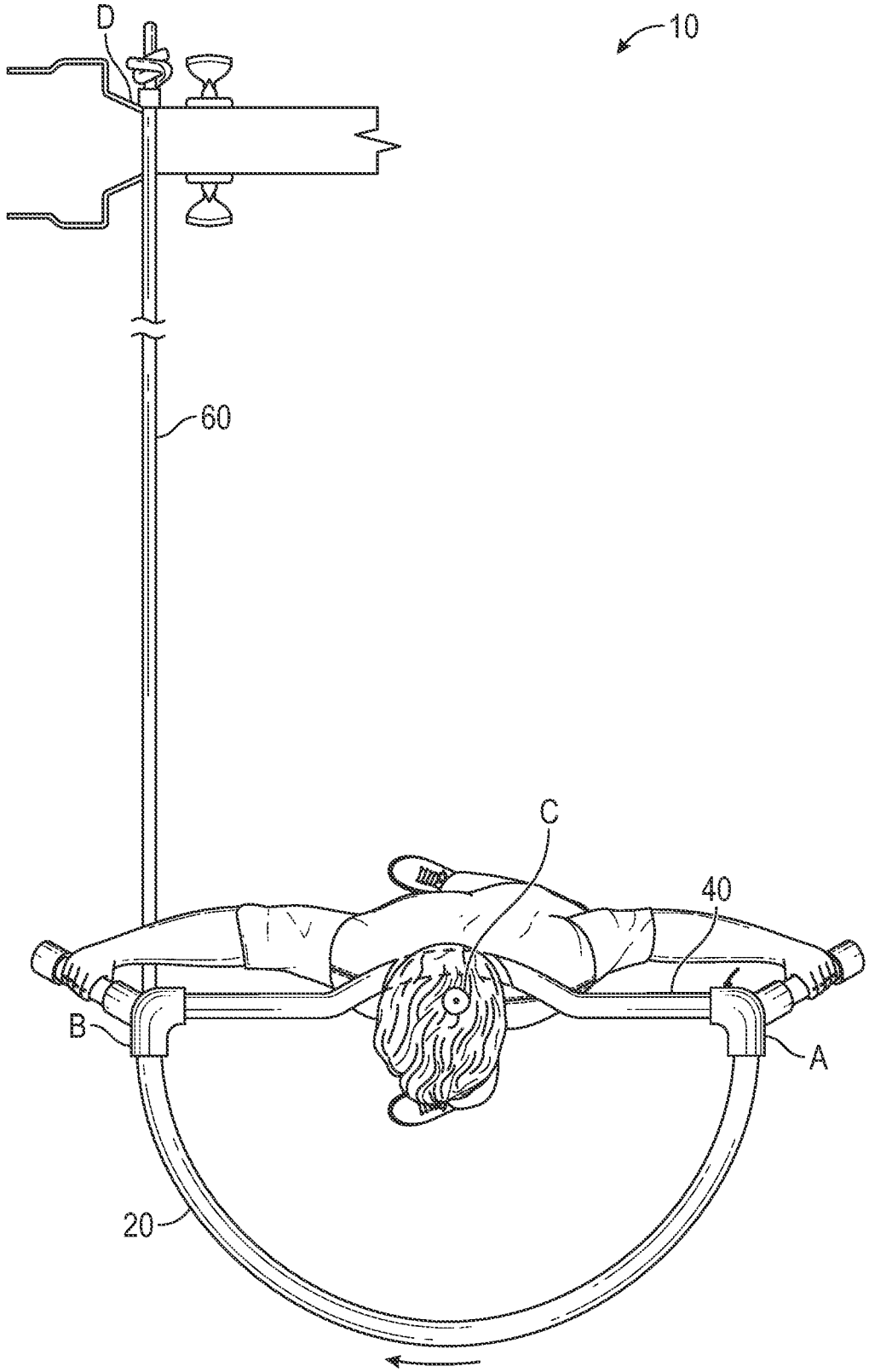
FIG. 3 is an overhead schematic view of the training apparatus of FIG. 1 in a third position.

FIGS. 1-3 are schematic overhead representations of a golf training apparatus 10 in three different use positions as the apparatus is rotated back and forth with the user's shoulders through a turn of approximately 180 degrees by the user standing in a fixed position at the center of rotation C. In use of the apparatus 10, the shoulders and the hips rotate while the feet remain in a fixed golf stance position substantially as shown in dotted lines while the user's core rotates with the apparatus.

The apparatus 10 is simple in construction. A semicircular portion 20 is coupled at end points A and B with a support portion 40. More detailed embodiments are described with reference to additional figures below. The support portion 40 is constructed to conform generally to the shoulders and neck of the user in order to provide comfortable support for the semicircular portion 20, which is held out in front of the user chest high and rotated in use with the user's shoulders. Handles 80 may be provided on each end of the support portion 40, for example, at points A and B, or at some other ergonomically advantageous position, to assist the user with operating the apparatus 10 properly.

Figure 9:
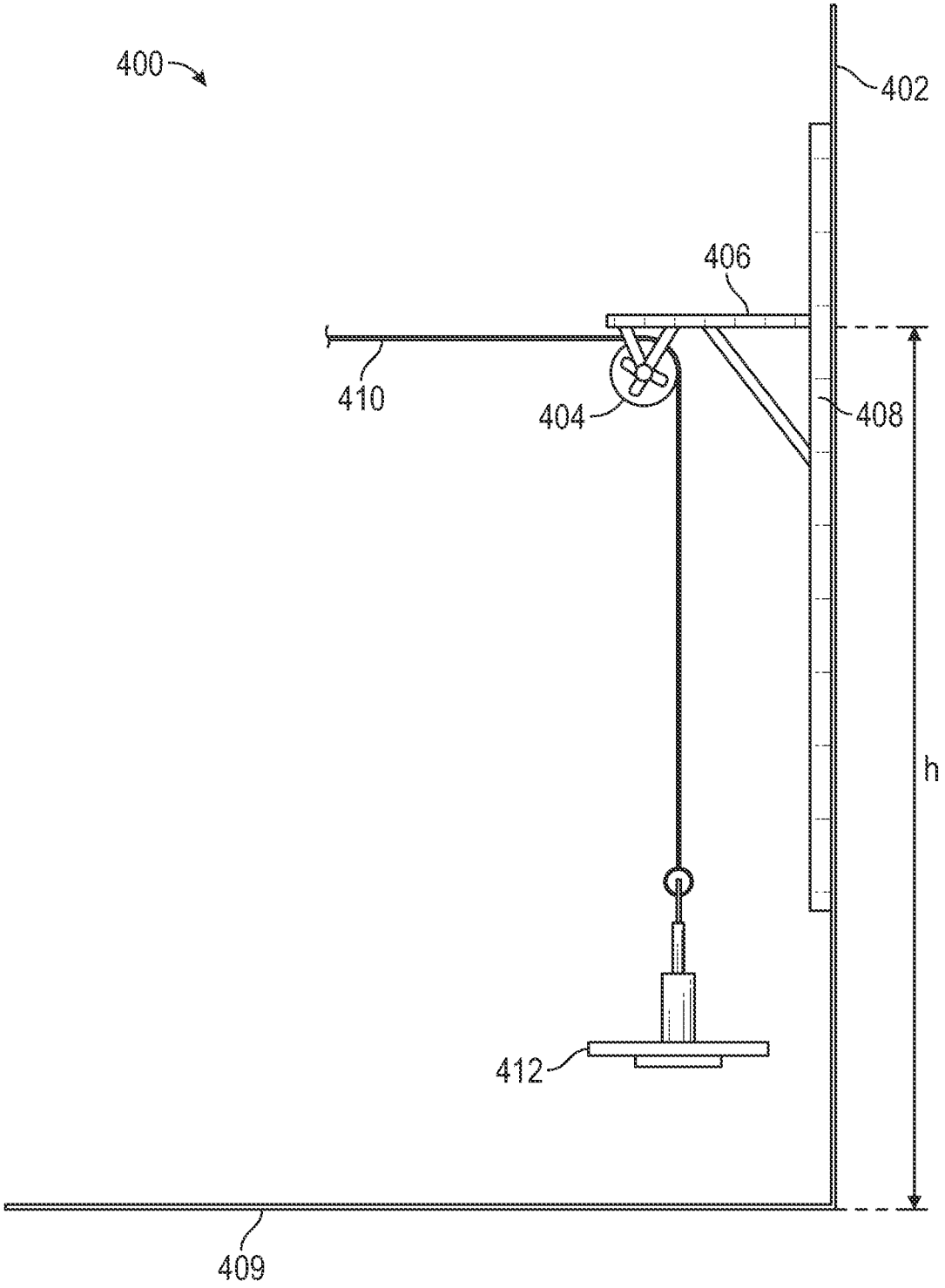
FIG. 9 is a side plan view of an embodiment of a pulley/weight system implemented as a resistance member.

A resistance member 60 of varying resistance, 60 is connected to point A of the apparatus 10 and also to a fixed point D separate and apart from the apparatus, for example, wedged into a door jam at the chest height of the user. While FIGS. 1-3 illustrate the use of a flexible tether as the resistance member 60, a pulley/weight system as illustrated in FIG. 9 below can also be used to create resistance. To use the apparatus 10 with the elastic tether, the user moves away from the door and stands in a ball-striking position turned 90 degrees from the door, as shown in FIG. 2, where the user's spinal column is the center point C for rotation of the semicircular portion, and the tether 60 is at a comfortable tension and wraps around the semicircular portion 20. The user rotates the shoulders and apparatus 10 away from the point of fixation in the door through 180 degrees of rotation while keeping the feet firmly planted on the ground, thus experiencing increasing tension on the tether 60 and working the user's rotatory core muscles to build strength and muscle memory to increase the speed of the golf club. As the user rotates the apparatus 10 and shoulders about center point C, the tether 60 follows its connection at point A and tracks around the semicircular portion 20. This motion is repeated to gain strength and muscle memory. The tethers are of varying resistance and are chosen depending on the strength and experience of the user. The weight pulley system has the advantage of producing consistent resistance throughout the rotational exercise In FIG. 1, the elastic tether 60 is at a minimum to moderate tension, depending on the users conditioning, between point A and point D, and the apparatus 10 coupled with user's shoulders is rotated approximately 90 degrees to the fully clockwise position while the user's legs and feet remain fixed.

In FIG. 2, the user has rotated shoulders and apparatus 10 counterclockwise approximately 90 degrees thus pulling and wrapping the tether 60 affixed at point A around the semicircular portion 20 to provide increased tension on the tether. In this position, the user's shoulders are facing front and aligned with the legs and feet in a normal golf stance.

In FIG. 3, the user has rotated shoulders and apparatus counterclockwise another 90 degrees thus pulling and wrapping the tether 60 affixed at point A further around the semicircular portion 20 to provide maximum tension on the tether.

The user exercises the core by repeating the clockwise and counterclockwise rotations in reasonable repetitions and sets. The views and directional references of FIGS. 1-3 would of course be reversed in orientation for a left-handed ball striker (or to provide a symmetrical core workout), for example, by affixing the tether to point B of the training apparatus instead of point A and the user turning around to face the other direction.

Also, varying the user's position in relation to the fixed point D will produce varying degrees of resistance for use of the apparatus 10. For example, as the user is positioned further away from point D, the resistance on the tether 60 will be greater. Since the apparatus 10 creates resistance to a rotary movement that involves muscles, joints and ligaments of the core, from the shoulders to the floor, it is recommended that one should start slowly and with a small resistance through the tether 60. Any exercise that places a new stress on a previously unrestrained motion should be initiated progressively, with caution.

Figure 4:
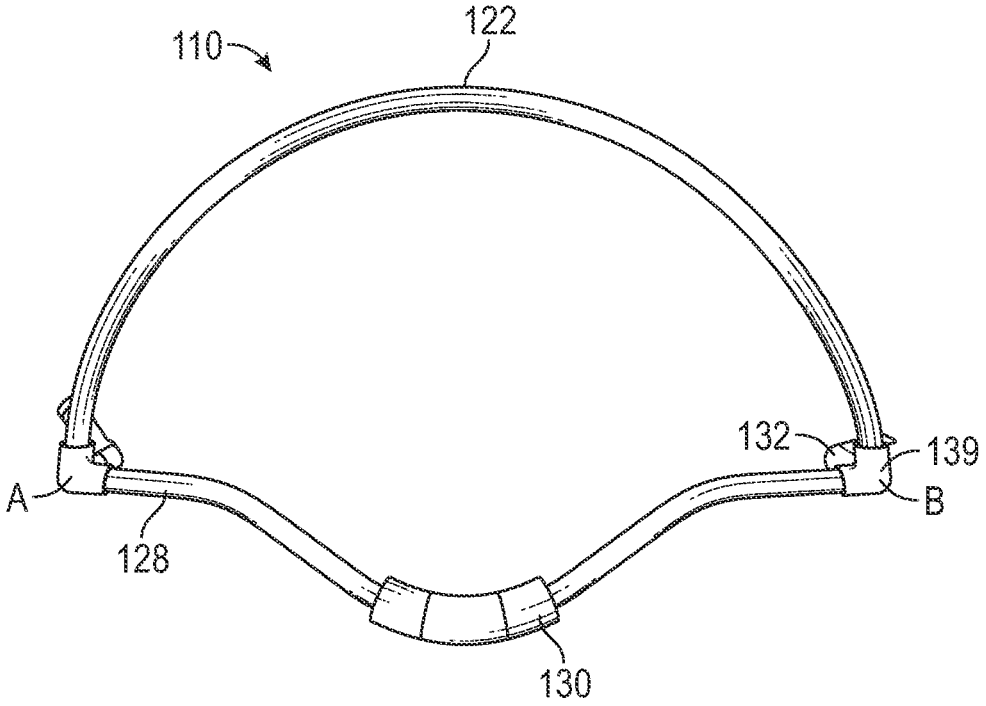
FIG. 4 is top plan view of a first embodiment of a training apparatus.
Figure 5:
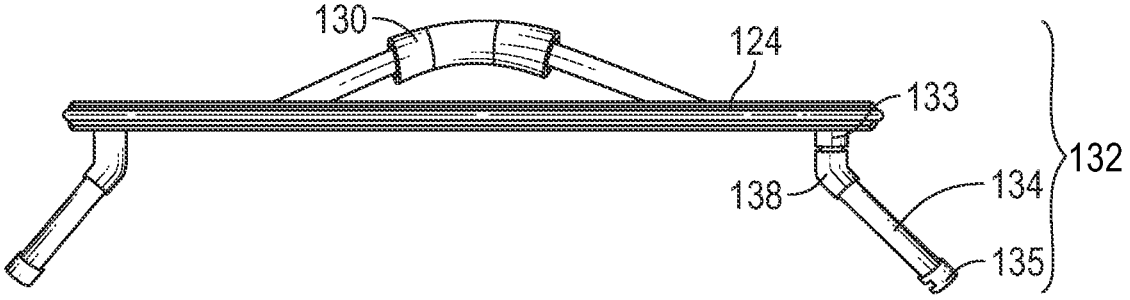
FIG. 5 is a side plan view of the first embodiment of FIG. 4.
Figure 6:
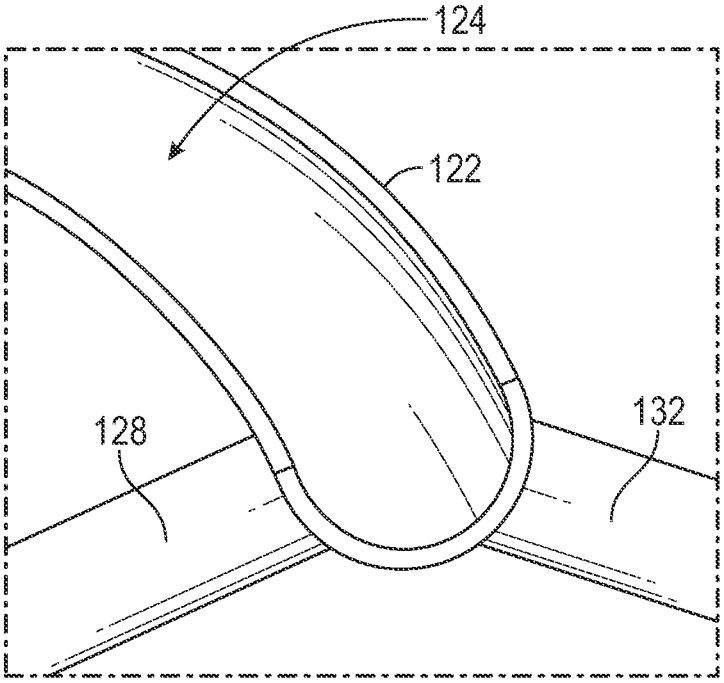
FIG. 6 is a perspective view of an end portion of the first embodiment of FIG. 4.

The training apparatus should preferably be lightweight and can be made from a variety of readily available materials, such as plastics, lightweight metal alloys, composite materials such as carbon fiber, etc. For example, a simple embodiment was made with lengths of ¾ inch Schedule 40 rigid PVC pipe and connectors, as illustrated in FIGS. 4-5. The apparatus 110 includes a first length of PVC pipe 122 having an opening 124 (see FIG. 5) formed along the entire length of its outward-facing surface 126, i.e., facing away from the user. In this specific embodiment, the cutaway opening 124 is made over approximately 45% of the outward-facing half of the first pipe 122. The length of the first pipe 122 should be adequate to form a complete or near-complete half circle with rotation clearance about the user; for example, a first length of approximately 30 inches is adequate for most adults. The first pipe 122 is bent to form the semicircular arc such that the cutaway portion 124 is exposed on the outward-facing surface 126 and forms an open pathway to guide the travel of the tether (not shown) during use.

A second length of PVC pipe 128 is coupled at each end by standard PVC connectors 139 to the first pipe 122. The second pipe 128 has been cut in half and symmetrical curves 129 formed with each half, then connected back together again with a standard connector. A neck cushion 130, such as a hollow cylindrical tube made of plastic foam or similar, is attached where the half pipes 128 connect to cover the connector and provide some additional comfort for the user.

Handles 132 are provided at each end of the apparatus, for example, and are coupled to extend downward from the end points A and B by connector 139, a three-way connector that also couples the first pipe 122 and second pipe 128. In this embodiment, each of the handles 132 is formed with a first straight piece 133 coupled to connector 139 on the apparatus 110; then extending into a elbow connector 138; then to a second straight piece 134 which acts as the handle grip; and terminating with an end cap 135. Grasping and using the handles to hold the apparatus in the horizontal plane of the user's shoulders facilitates a good core workout.

In use, a tether may be secured to either point A or point B on the apparatus 110, for example, by tying the tether in a knot around the corner connector 139 or similar location on the apparatus. Alternatively, a connection point may be affixed on the apparatus 110, for example, with an eye hook, eye bolt or other known mechanical attachment means affixed into one of the pipes or connectors symmetrically on the apparatus.

The tether may be, for example, a silicone band, silicone tubing, a rubber band, rubber tubing, or similar materials with an elastic characteristic suitable for resistance exercises. The elastic tether can be replaced by attaching the device to an adjustable pulley/weight system adjustably secured to a wall or other exercise device commonly used at gyms and other fitness centers.

In an implementation of the above embodiment, the apparatus 110 could be formed as a single molded piece with a neck support cushion added to the molded product. The tether may be included with the apparatus or attached separately.

In fact, implementing a guide path for the travel of the tether along the semicircular arc could be accomplished in a number of different ways without departing from the scope of this disclosure. In general, the guide path can be provided through an internal pathway of an arc portion structural member or an external pathway on the outward-facing surface of the structural member.

Figure 7:
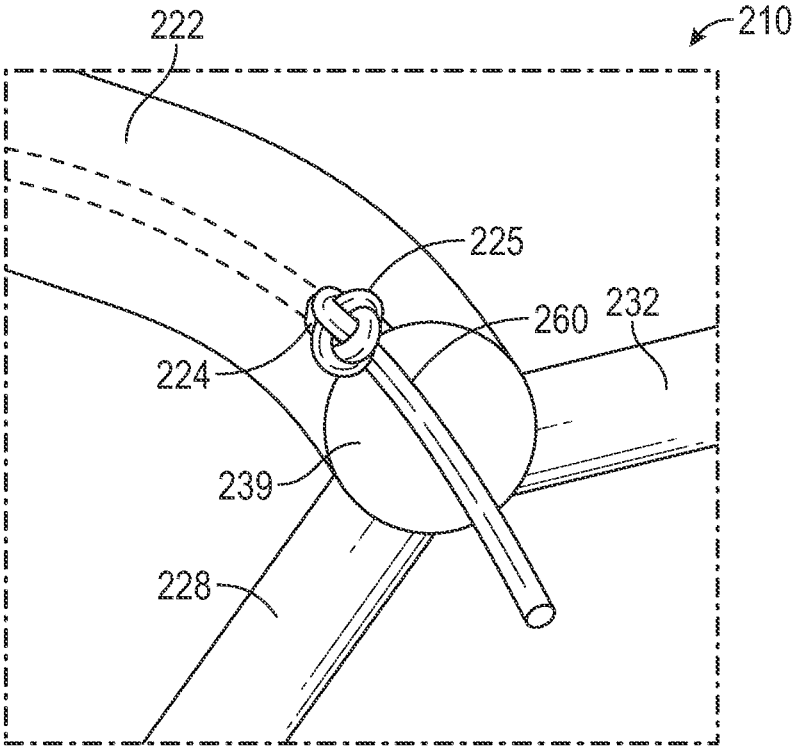
FIG. 7 is a perspective view of an end portion of a second embodiment of a training apparatus.

For example, another implementation is illustrated in FIG. 7, showing one end of the cylindrical apparatus 210 where the first portion 222 forming the semicircular arc is coupled at connector 239 to the second portion 228 and the handle 232. However, in this embodiment, the arc portion does not have an opening along the full length of the outward-facing surface, but instead is a mostly solid external surface with a hollow interior—as in standard PVC pipe or similar—with small cutouts 224 formed at each end on the outward-facing surface for receiving the tether 260 through the hollow tube with adequate length to conduct the exercise as described. Alternatively, with the tether fixed at the leading end of the semicircular arc portion, a single cutout could be provided at the following end for the tether to ride in and out through the guide path.

The tether 260 may also be affixed with a mechanical stopper 225 at each end to limit travel of the tether, or a simple knot tied in the tether may be adequate. The cutouts 224 may also be fitted with a grommet or similar mechanical hardware to facilitate the tether having a smooth entry to and exit from the tube at the cutouts.

Figure 8:
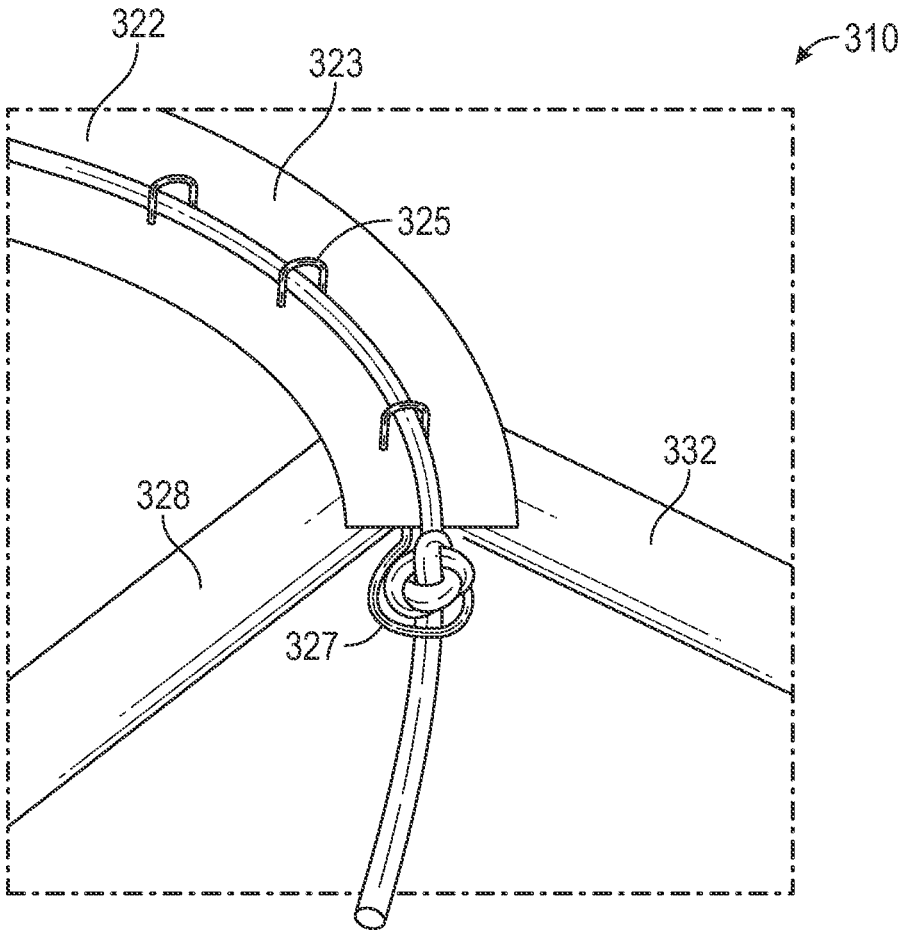
FIG. 8 is a perspective view of an end portion of a third embodiment of a training apparatus.

In yet another implementation, as shown in FIG. 8, the apparatus 310 is not made from a hollow pipe or tubing, but instead is a rigid member 322, such as a composite material or metal alloy, forming the semicircular arc portion and having a substantially flat outward-facing surface 323 along the arc. The support member 340 and the handles 332 can be formed of the same material and coupled at point A in known manner for the material chosen. A number of rings 325 are affixed on outward-facing surface 323 of the arc member 322 to provide a guide path for travel of the tether 330. An eyebolt 327 or some other attachments means is provided at each end of the rigid arc member 322 for securing the tether in preparation for exercise.

FIG. 9 illustrates an embodiment of the resistance member implemented as a pulley/weight system 400 attached to a wall 402. The pulley/weight system 400 may use a pulley 404 or other cylindrical device rotatably secured by a L bracket 406 that is secured to the wall 402 by a wall plate 408 that enables the height of the L bracket from the floor to be adjusted. The height h of the L bracket 406 from the floor 409 may be adjusted upward or downward on the wall plate 408 depending upon the height of the user. The pulley 404 may have a channel or other mechanism for slidably receiving a rope 410 that is secured to the attachment point of the semicircular portion 20 of the training device at one end and one of more weights 412 at the other end that serve as a counterweight. As known to those skilled in the art, the number of weights 412 may be adjusted by the user to increase or decrease the resistance provided by the pulley/weight system 400. Rope 410 may be a synthetic rope or wire rope such as a cable.

The foregoing written description is intended to enable one of ordinary skill to make and use the techniques described herein, but those of ordinary skill will understand that the description is not limiting and will also appreciate the existence of variations, combinations, and equivalents of the specific embodiments, methods, and examples described herein.

The invention claimed is:

1. A training apparatus, comprising:

a first member having a substantially semicircular shape with an outward-facing portion, a leading end and a following end;

a second member coupled between the leading end and the following end of the first member and adapted, in use, to extend across shoulders and neck of a user behind the user's neck with the first member held up in front of the user; and an attachment point at the leading end;

whereupon attaching a resistance member between the attachment point and a fixed point adjacent the training apparatus located at an approximate chest height of the user, the training apparatus is configured to rotate back and forth at the approximate chest height about a center rotational axis of the first member with the user's shoulders while the user's feet remain in a fixed position such that the resistance member rides back and forth on the outside-facing portion to increase and decrease tension on the resistance member to create resistance to core muscles of the user.

2. The training apparatus of claim 1, wherein the first member is a hollow cylindrical tube having an opening formed along a length of the tube on the outward-facing portion, the resistance member riding in the tube in use.

3. The training apparatus of claim 1, wherein the first member is a hollow cylindrical tube having two cutouts formed on the outward-facing portion, a first cutout formed at the leading end and a second cutout formed at following end, the resistance member riding in and out through the tube via the two cutouts.

4. The training apparatus of claim 3, wherein the first member is a hollow cylindrical tube having at least one cutout formed on the outward-facing portion at the following end, the resistance member riding in and out through the tube in use via the at least one cutout.

5. The training apparatus of claim 1, wherein the first member is formed with a substantially flat surface having a guide path on the outward-facing portion, the resistance member riding in the guide path.

6. The training apparatus of claim 5, wherein the guide path is a plurality of rings arranged along the substantially flat surface.

7. The training apparatus of claim 5, wherein the second member is formed to have a rearward-curving portion for wrapping around the user's neck at a center of the second member.

8. The training apparatus of claim 1, further comprising:

two handles, a first handle affixed proximate to the leading end of the first member and a second handle affixed proximate to the following end of the first member.

9. The training apparatus of claim 1, wherein the resistance member comprises a tether made from synthetic elastic material or a natural elastic material.

10. The training apparatus of claim 1, wherein the resistance member comprises a cable over a pulley secured to a counterweight.

11. An apparatus, comprising:

a semicircular member having a first end and a second end, the semicircular member sized and configured for rotation about a user standing at a center rotational axis of the semicircular member;

a support member coupled between the first end and the second end of the first semicircular member, the support member adapted to rest laterally across shoulders and neck of the user with the semicircular member held in front of the user; and a resistance member having a first end and a second end, the first end of the resistance member affixed to the first end of the semicircular member;

whereupon attaching the second end of the resistance member to a fixed point adjacent the apparatus located at an approximate shoulder height of the user, the apparatus being configured to rotate back and forth at an approximate chest height about the center rotational axis of the semicircular member with the user's shoulders while the user's feet remain in a fixed position such that the resistance member is guided back and forth along the semicircular member during rotation to create resistance to core muscles of the user.

12. The apparatus of claim 11, further comprising, wherein the semicircular member having an outward-facing portion and a guide path formed on the outward-facing portion, the flexible resistance member rides back and forth in the guide path.

13. The apparatus of claim 12, wherein the semicircular member is a hollow cylindrical tube having an opening formed along the outward-facing portion as the guide path for the resistance member.

14. The apparatus of claim 12, wherein the semicircular member is a hollow cylindrical tube having a first cutout formed at the first end and a second cutout formed at second end, the resistance member riding in and out through the tube via the first and second cutouts.

15. The apparatus of claim 12, wherein the semicircular member is a hollow cylindrical tube having a first cutout formed on the second end of the outward-facing portion, the resistance member riding in and out through the tube in use via the first cutout.

16. The apparatus of claim 12, wherein the semicircular member is formed with a substantially flat surface having the guide path on the outward-facing portion.

17. The apparatus of claim 16, wherein the guide path is a plurality of rings arranged along the substantially flat surface.

18. The apparatus of claim 11, wherein the support member includes a rearward-curving portion for wrapping around the user's neck at a center of the support member.

19. The apparatus of claim 11, further comprising:

a first handle affixed proximate to the first end of the semicircular member and a second handle affixed proximate to the second end of the semicircular member.

20. The training apparatus of claim 11, wherein the resistance member comprises a tether made from synthetic elastic material or a natural elastic material.

21. The training apparatus of claim 11, wherein the resistance member comprises a rope over a pulley secured to a counterweight.

22. An apparatus, comprising:

a semicircular member having a first end and a second end, the semicircular member sized and configured for rotation about a user standing at a center rotational axis of the semicircular member;

a support member coupled between the first end and the second end of the semicircular member, the support member adapted to rest laterally across shoulders and neck of the user with the semicircular member held in front of the user; and a resistance member comprising a rope having a first end secured to the first end of the semicircular member and a second end secured to a counterweight, the rope being slidably secured over a pulley attached to a fixed point adjacent the apparatus located at an approximate shoulder height, of the user, the apparatus being configured to rotate back and forth at an approximate chest height about the center rotational axis of the semicircular member with the user's shoulders while the user's feet remain in a fixed position such that the resistance member rides back and forth along the semicircular member during rotation to create resistance to core muscles of the user.

* * * * *